United States Patent [19]

Shinn

[11] 4,304,311

[45] Dec. 8, 1981

[54] DRILL STRING STABILIZER HAVING EASILY REMOVED HARD SURFACE INSERTS

[76] Inventor: Kim E. Shinn, 9002 Triola, Apt. B, Houston, Tex. 77036

[21] Appl. No.: 89,532

[22] Filed: Oct. 29, 1979

[51] Int. Cl.[3] ..... E21C 9/00; F16C 1/26

[52] U.S. Cl. ..... 175/325; 175/410; 308/4 A

[58] Field of Search ..... 175/325, 323, 410, 374, 175/408, 262, 97, 399; 294/86.34; 308/4 A; 166/241

[56] References Cited

U.S. PATENT DOCUMENTS

| | | | |
|---|---|---|---|
| 1,045,954 | 12/1912 | Decker | 175/406 X |
| 2,657,907 | 11/1953 | Cochran et al. | 308/4 A |
| 3,285,678 | 11/1966 | Garrett et al. | 308/4 A |
| 3,311,181 | 3/1967 | Fowler | 175/410 |
| 3,480,094 | 11/1969 | Morris | 175/325 |
| 4,081,203 | 3/1978 | Fuller | 175/325 X |
| 4,190,126 | 2/1980 | Kabashima | 175/410 |

FOREIGN PATENT DOCUMENTS

| | | | |
|---|---|---|---|
| 627230 | 11/1978 | U.S.S.R. | 175/325 |
| 641060 | 8/1979 | U.S.S.R. | 175/410 |

*Primary Examiner*—James A. Leppink

*Attorney, Agent, or Firm*—Pravel, Gambrell, Hewitt, Kirk, Kimball & Dodge

[57] ABSTRACT

A drilling tool apparatus having easily released hard surface wear inserts for use in earth boring operations of the fixed blade stabilizer type is disclosed. Tungsten carbide inserts are preferably used on the wear surfaces of a fixed blade stabilizer and are formed where the tungsten carbide inserts may be released and dropped down the bore hole if it becomes necessary to free the stuck stabilizer by washover operations.

A method for easy release of wear resistant inserts as used in the wall contact surfaces of earth boring drill string stabilization tools is disclosed. The inserts are formed and placed in the stabilization tool wall contact surfaces in such a way that the inserts may be released and dropped downhole should it be necessary to washover the stuck drill string.

3 Claims, 10 Drawing Figures

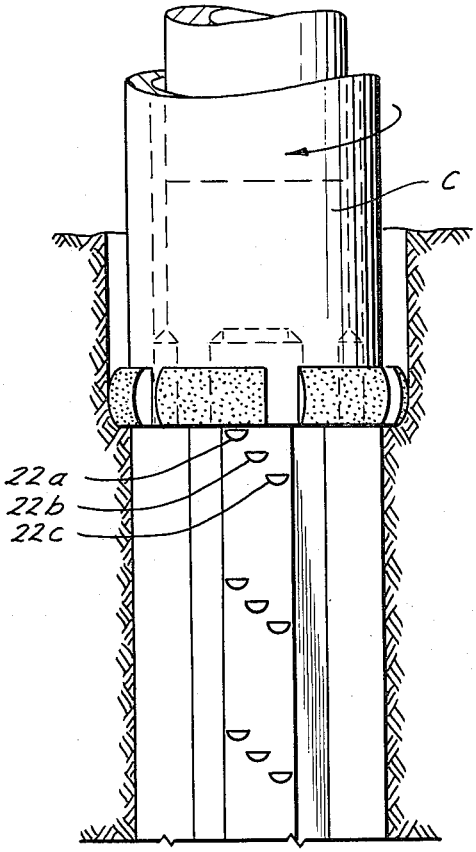
Fig. 7
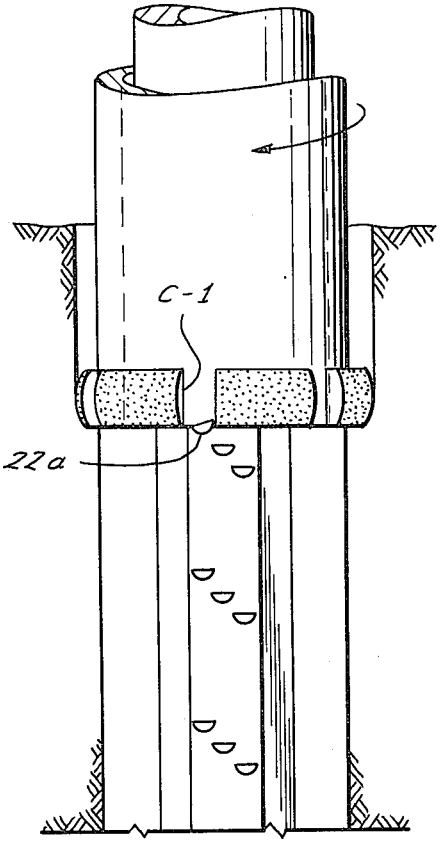
Fig. 8
Fig. 9
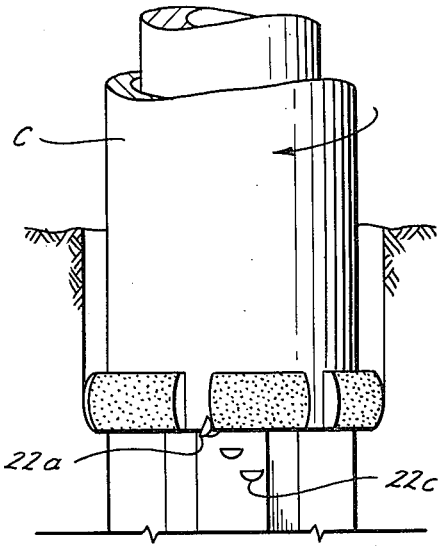
Fig. 10
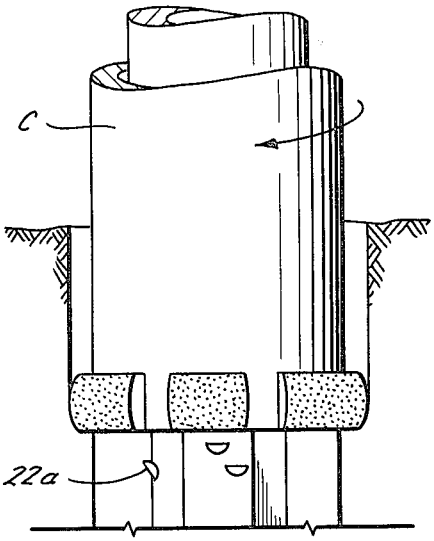

DRILL STRING STABILIZER HAVING EASILY REMOVED HARD SURFACE INSERTS

TECHNICAL FIELD

This invention relates generally to a drill string stabilizer protector used in earth boring operations and more specifically, to a drill string protector utilizing inserts of wear resistant material, usually tungsten carbide, that can be released with a conventional washover milling tool in the event the drill string becomes stuck in the bore hole.

This invention relates generally to a drill string stabilization tool as used in earth boring operations and more specifically, to the use of wear resistant inserts in the relatively soft stabilizer body such that the inserts and subsequently the tool and drill string, may be easily released with a conventional washover milling tool, in the event the drill string becomes stuck in the well bore.

BACKGROUND ART

In conventional rotary drilling or earth boring operations, stabilization tools are placed above the drill bit in the drilling string. These stabilization tools employ two basic methods of maintaining the orientation of the drill bit about its axis and ideally, also the drill string axis of rotation. Such tools minimize drift of the bore hole from the vertical or any other preferred azimuthal angle. The first method is tool rigidity itself and the second method is tool contact with the well bore wall. Inasmuch as continual circulation of drilling fluid down through the inner bore of the drill string and returning up through the annular area between the drill string and the bore hole wall must be maintained, the second method of stabilization is most usually obtained through the use of "ribs", "ridges" or "blades" which protrude out from the main body of the tool in contact with the bore hole wall. The interstitial area between these blades provides the annular area or volume necessary for return of circulating fluid used in rotary drilling operations.

One example of the present invention occurs in the tool commonly known as a square drill collar which combines the utilization of both methods and an example of such tool can found in U.S. Pat. No. 3,343,615. The body of the tool is heavy walled and rigid, while at 90° intervals around the circumference of the tool, ribs protrude to make contact with the well bore and run the axial length of the tool, usually some 30 feet. The diagonal measure between opposite rib surfaces is very nearly exact hole size and the rib surfaces are rounded to effect maximum contact area with the bore hole wall.

Because the tool's rib surfaces are in constant contact with the bore hole wall to provide maximum stabilization and prevent azimuthal deviation, these ribs are provided with protection against the erosion and abrasion effected by hard abrasive geologic formations. If not protected by hard metal stripping or insertion of ultra-hard material into the mild carbon steel, the contacting surface will abrade and the tool will progressively lose its effectiveness. Use of such inserts in such a tool is disclosed for example in Canadian Pat. No. 658,049.

In the current technology, it is common to insert buttons of an ultra-hard material such as tungsten carbide into the mild steel of the tool body. Additional examples of such tools are found in U.S. Pat. Nos. 3,680,647; 4,060,286; and 2,288,124. These inserts must bear against the well bore wall, providing for tool contact, however, this ability to withstand abrasion makes the tool fitted with these inserts extremely difficult to free when wedged or stuck solidly downhole. When a drill string is "wedged" or "stuck" downhole, a number of means may be employed to release or "unstick" the drill string. Commonly a washover procedure is used as mentioned in U.S. Pat. No. 3,318,398.

In washing over, a large bit or "shoe" is used to pass over the outside wall of the drill string and mill away all obstructions between the nominal diameter of the drill string and the actual diameter of the well bore. When this washover shoe encounters aluminum, rubber, iron or mild steel, it can effectively mill away the materials. If, however, the conventional shoe encounters ultra-hard material such as tungsten carbide buttons used in the stabilizing tools, it is woefully ineffective and is often broken or severly damaged, bringing washover operations to a halt and leaving the drill string still "wedged" in the bore hole. It is possible to use a diamond tooth washover shoe to mill away the hard metal obstructions. However, these shoes must be custom made and the expense and fabrication and drilling downtime is often so high as to make this course of action less desirable than abandonment of the well.

DISCLOSURE OF INVENTION

In the present invention, the ultra-hard material inserts are used in a configuration which will enable the use of conventional tools in washover operations. In one instance, these inserts are formed from sintered tungsten carbide grains in the shape of a right circular cylinder sectioned laterally down its longitudinal axis. The inserts are then placed in the mild steel encasements of a drill string stabilizer rib oriented with the flat blade of the insert very nearly perpendicular to the longitudinal axis of the stabilizer body and drill string.

In this configuration, during washing over operations the milling action of the conventional shoe will cut away the mild steel uphole from the ultra-hard material insert. When the washover shoe contacts the insert, the shoe will catch on the edge of the insert and easily roll it away from the mild steel around it and push the insert into the well bore and drop it downhole. When washover operations are completed, the milled out inserts are then retrieved with a conventional "junk" basket.

It is important to note that the unique configuration of the inserts themselves as well as the arrangement of the inserts in the mild steel encasement matrix facilitate removal of the inserts during washover. Just before the washover shoe makes contact with the hard surface of the wear resistant insert, all of the encasement steel uphole of the insert will have milled away. As it is this confining pressure of the encasement material that holds the insert in place, the removal of that material and its interference with the material of the insert enables the washover shoe to merely roll out the entire insert. Thus, it is not necessary for the washover shoe to actually abrade or mill the ultra-hard material of the insert.

BRIEF DESCRIPTION OF THE DRAWINGS

FIG. 7 is a side view of the milling operation of the present invention; and

FIGS. 8, 9 and 10 are views similar to FIG. 7 and illustrate progress of the milling operation.

BEST MODE FOR CARRYING OUT THE INVENTION

Figure 1:
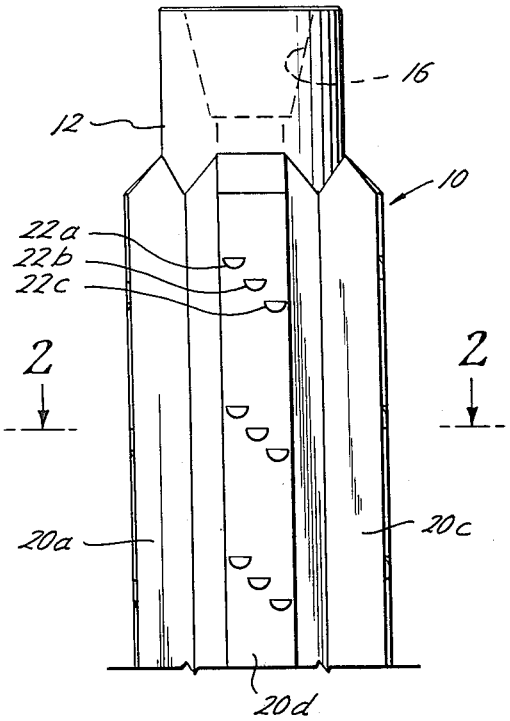
FIG. 1 is a side view of a drill stabilizer apparatus illustrating use of the present invention.
Figure 4:
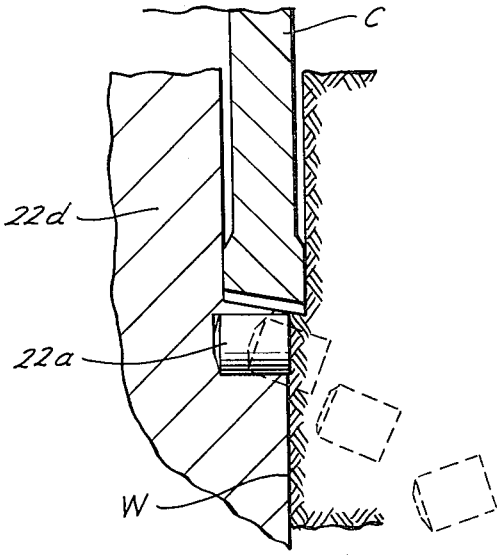
FIG. 4 is a side view illustrating the release of the wear resistant inserts.
Figure 2:
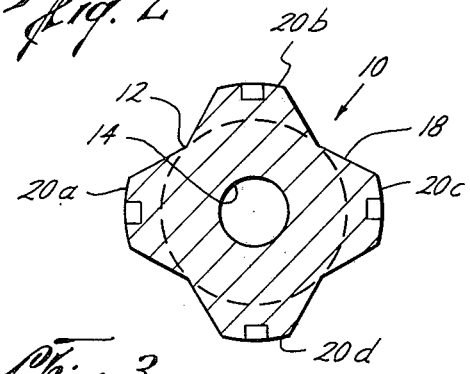
FIG. 2 is a view taken along lines 22 of FIG. 1.

A drill string stabilizing apparatus constructed in accordance with the present invention is illustrated in FIGS. 1 and 2. The drill stabilizer apparatus 10 is formed by substantially thick wall tubular body 12 having a longitudinal bore 14 extending therethrough. A threaded box-type connector 16 is provided at the upper end of the tubular body 12 and a pin connector (not illustrated) is provided on the lower end for enabling connection of the drill stabilizer apparatus 10 in the drill string in the usual manner as well known in the art. When so connected drilling fluid is circulated down through the bore 14 of the drill stabilizer apparatus 10 through the drill bit and upwardly through the annular area between the drill string and the bore hole wall W. (FIG. 4).

The tubular body 12 forms an outer or external surface 18 having a plurality of 90° or 120° circumferentially spaced external ribs or ridges formed thereon for engaging the bore hole wall W for stabilizing the drill string in the usual manner. The longitudinal extended ridges 20*a*, 20*b*, 20*c* and 20*d* extend the effective length of the drill stabilizer apparatus 10.

Figure 3:
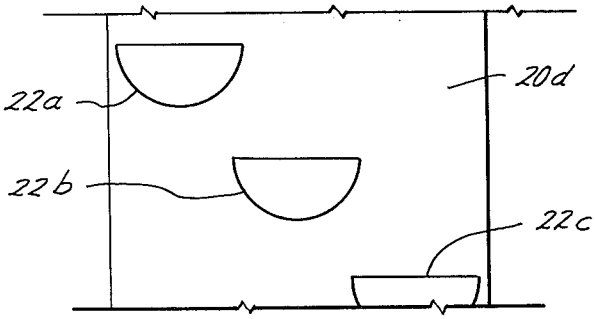
FIG. 3 is a view of the hard surface wear resistant inserts.

Each of the ridges 20*a*, 20*b*, 20*c* and 20*d* have a rounded outer portion for engaging the wall W of the bore hole for maintaining the alignment of the longitudinal axis of the drill string with the bore hole. Each of the rounded outer surfaces is provided with a plurality of recesses receiving a corresponding plurality of ultra-hard, wear resistant inserts 22*a*, 22*b* and 22*c*, arranged to provide the entire wear surface of the ridge 20*d* with a band of wear resistant material. The wear resistant band pattern of the inserts 22*a*, 22*b*, and 22*c* is repeated at selected distance along the ridge 20*d*. The other ridges 20*a*, 20*b* and 20*c* are provided with the plurality of spaced band pattern of inserts as illustrated in FIG. 1. The band pattern of inserts 22*a*, 22*b* and 22*c* are illustrated in greater detail in FIG. 3, which details the vertical overlap of the inserts 22*a*, 22*b* and 22*c*. Each of the inserts 22*a*, 22*b* and 22*c* is in the form of a right circular cylinder that has been bisected along its longitudinal axis. Preferably, the inserts are pressed into openings or recesses of the same cross sectional shape on the ridge 20*d*, but other methods of securing may be employed. The essential feature is that when the metal above the insert is milled away, the insert will pop out when engaged by the washover cutter as illustrated in FIG. 4 and it is not necessary for the washover cutter to mill away the ultra-hard material inserts in place. The circular lower surface of the insert 22*a* is so arranged that when the washover cutting tool C engages the top of the insert 22*a* it will pop the insert out of the recess where it will fall between the ridges 20*a*, 20*b*, 20*c* and 20*d* to the bottom of the bore hole. After the washover operation is completed and the tubular body 12 is retrieved, a normal "junk" basket may be run in the bore hole to retrieve the inserts and enable continued drilling operations.

Figure 5:
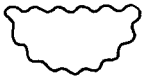
FIG. 5 is an end view of another embodiment of the hard surface wear resistant insert.
Figure 6:
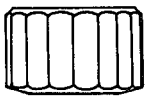
FIG. 6 is another view of the wear resistant insert of FIG. 5.

In FIGS. 5 and 6 is illustrated another embodiment of a tungsten carbide insert that may be used in accordance with the present invention. These inserts have substantially the same semi-circular cross sectional shape of the first embodiment, but are provided with greater edge surface for securing to the tool.

FIG. 7 illustrates a washover shoe C as it approaches first hard metal inserts 22*a*, 22*b* and 22*c*, which are tilted off perpendicular a few degrees, the first point of contact between washover shoe and insert being on the reverse side of the direction of rotation D of washover pipe and washover shoe C, causing insert 22*a* to be pried and rolled out of its recess when the insert comes in contact with the trailing side of the "water course" C-1 as illustrated in FIG. 8. As washover assembly C continues its rotation the insert 22*a* because of its unique configuration, is levered up into "water course" C-1 and carried around to the annular space between the ridges 20*a* and 20*b* of the stabilizer as illustrated in FIG. 9, and continuing until it is completely above the space and drops to bottom as illustrated in FIG. 10. The milling process continues down through mild steel ridges 20*a*, 20*b*, 20 *c* and 20*d* until washover shoe C contacts insert 22*b* next in series where the above described process is repeated and continuing down the length of the entire protruding ridges until all inserts have been released and stabilizer is freed.

USE AND OPERATION OF INVENTION

In the use and operation of the present invention the tubular body 12 is made up in the drill string in the usual manner, preferably immediately above the drill bit. During normal drilling operations, the ultra-hard material inserts, 22*a*, 22*b* and 22*c* will engage the wall W of the bore hole for stabilizing the drill string rotation. When the tubular body 12 becomes stuck in the bore hole by wedging against the bore hole wall W, it may be necessary to run the washover cutting tool to free the tubular body 12. As the cutting member C cuts away the ridges 20*a*, 20*b*, 20*c* and 20*d* to free the tool 10, the cutting member C will come into engagement with the ultra-hard insert 22*a*. As the washover cutting tool C engages the insert 22*a*, it will scoop it out of the opening in which it had been secured and deposit it between the ridges 20*a*, 20*b*, 20*c*, and 20*d* where it will drop down the bore hole. This will enable the milling operation to proceed to free the tool 12 without the necessity of cutting through each of the ultra-hard material inserts.

The foregoing disclosure and description of the invention are illustrative and explanatory thereof, and various changes in the size, shape and materials as well as in the details of the illustrated construction may be made without departing from the spirit of the invention.

I claim:

1. A drill stabilizer apparatus for use in earth boring operations, comprising:

a substantially tubular body having an outer surface and a bore extending therethrough;

means at each end of said tubular body for enabling threaded connection in a drill string;

said outer surface having a plurality of circumferentially spaced external ridges formed thereon for engaging the walls of a bore hole for stabilizing the drill string;

a plurality of hard surface inserts carried in a corresponding plurality of recesses, each of said external ridges for enhancing wear resistance of said external ridges; and each of said hard surface inserts secured in a corresponding recess for release from said recess upon initial engagement by a milling cutter to prevent milling of the inserts when said external ridges are being cut away; and each of said plurality of recesses has substantially a semi-circular cross section to enable the hard surface insert to release when a milling cutter engages the recess.

2. The drill stabilizer apparatus of claim 1, wherein:

each of said plurality of recesses having the flat portion of the semi-circle as the top of the recess.

3. A drill stabilizer apparatus for use in earth boring operations, comprising:

a substantially tubular body having an outer surface and a bore extending therethrough;

means at each end of said tubular body for enabling threaded connection in a drill string;

said outer surface having a plurality of circumferentially spaced external ridges formed thereon for engaging the walls of a bore hole for stabilizing the drill string;

a plurality of hard surface inserts carried in a corresponding plurality of recesses, each of said external ridges for enhancing wear resistance of said external ridges; and each of said hard surface inserts secured in a corresponding recess for release from said recess upon initial engagement by a milling cutter to prevent milling of the inserts when said external ridges are being cut away; and said inserts have a substantially semi-circular cross section to enable the insert to release when engaged by the milling cutter.

* * * * *